US007127755B1

(12) United States Patent
Stacy et al.

(10) Patent No.: US 7,127,755 B1
(45) Date of Patent: Oct. 31, 2006

(54) MATTRESS ASSEMBLY

(76) Inventors: Thomas J. Stacy, 2321 Sheridan Ave., Niskayuna, NY (US) 12309; Henry Fialkowski, Jr., 1174 Helderberg Ave., Schenectady, NY (US) 12306; Samuel L. DiLiberto, Jr., 152 North St., Caledonia, NY (US) 14423

( * ) Notice: Subject to any disclaimer, the term of this patent is extended or adjusted under 35 U.S.C. 154(b) by 0 days.

(21) Appl. No.: 10/904,144

(22) Filed: Oct. 26, 2004

Related U.S. Application Data

(60) Provisional application No. 60/514,797, filed on Oct. 27, 2003.

(51) Int. Cl.
*A47C 21/08* (2006.01)

(52) U.S. Cl. ..... 5/424; 5/425; 5/427; 5/663

(58) Field of Classification Search ..... 5/424–427, 5/732, 946, 663
See application file for complete search history.

(56) References Cited

U.S. PATENT DOCUMENTS 3,402,409 A * 9/1968 Kain ..... 5/426
3,616,469 A * 11/1971 Injeski ..... 5/171
4,178,645 A * 12/1979 Cosme ..... 5/426
4,233,699 A * 11/1980 Amato ..... 5/426
4,483,028 A * 11/1984 Payne ..... 5/426
4,672,698 A * 6/1987 Sands ..... 5/424
4,783,864 A * 11/1988 Turner ..... 5/424
5,035,014 A * 7/1991 Blanchard ..... 5/424
5,437,067 A * 8/1995 Bernstein et al. ..... 5/426
5,926,873 A * 7/1999 Fountain ..... 5/424
6,481,030 B1 * 11/2002 Bravo et al. ..... 5/425
6,721,974 B1 * 4/2004 Wilkinson ..... 5/425

* cited by examiner

*Primary Examiner*—Michael Trettel
(74) *Attorney, Agent, or Firm*—Jay R. Yablon

(57) ABSTRACT

A side panel safety apparatus for a bed, and a related method comprises: a horizontal stabilizer for placement at least partially underneath a mattress of said bed; and a vertically-extending panel attached substantially perpendicularly thereto; wherein: placement of said horizontal stabilizer at least partially underneath said mattress secures said vertically-extending panel in a substantially-vertical orientation along a side of said bed. One embodiment further comprises a cover covering both said mattress and said horizontal stabilizer. Another embodiment comprises the foregoing side panel safety apparatus in combination with a safety rail of said bed, further comprising: said safety rail; wherein: said horizontal stabilizer blocks a person in said bed from moving a part of said person's body into contact with said safety rail such that said body part becomes entrapped from said contact. Another embodiment comprises: said vertically-extending panel comprising at least two movable vertical sections; said horizontal stabilizer comprising at least two horizontal stabilization sections, each said horizontal stabilization section attached substantially perpendicularly to one of said movable vertical sections; and a hinge assembly between two adjacent said movable vertical sections enabling said adjacent movable vertical sections to be rotated relative to one another within a vertical plane of said movable vertical sections.

18 Claims, 9 Drawing Sheets

MATTRESS ASSEMBLY

CROSS-REFERENCE TO RELATED APPLICATIONS

This application claims benefit of U.S. provisional application 60/514,797, filed Oct. 27, 2003.

BACKGROUND OF THE INVENTION

Patients in hospital or long-term care facilities often reside in beds disposed between safety rails. Although the use of these safety rails provides some degree of protection against the risk of the patient falling off the bed, these safety rails present their own safety concerns. Patients, especially elderly or "developmentally disabled" patients, frequently injure themselves by trapping their heads, arms, legs, or other body parts between the safety rails and the mattress. In extreme cases, deaths have also occurred due to these entrapments.

FIG. 1 is a perspective view of a bed assembly 63 comprised of a mattress 12 and foundation 14, according to the prior art.

Disposed on bed assembly 63 are Bed Safety Rail (BSR) assemblies 48 and 49 respectively, shown in the raised or upper operating position. BSR 48/49 are held in place by two adjustable lateral supports 50 and 51 respectively. Lateral supports 50/51 extend at least the width of mattress 12 and are disposed between mattress 12 and foundation 14. In the lowered or down configuration, the BSR 48/49 are irrelevant to patient safety as the patient, not shown, is generally out of bed when the BSR 48/49 are in this configuration. These prior art BSR assemblies are generally manufactured of metal but could be made of any material and be in any configuration or shape of those BSR assemblies currently available on the open market.

Referring to FIG. 1, the length of BSR assemblies 48/49 respectively, is typically not coextensive with the length of mattress 12. In one embodiment, the differences between these lengths 53, 54, 53*a* and 54*a* respectively are from about 2 to 24 inches. As is apparent, these differences create inherent "gaps" that pose a substantial risk to the patient, becoming entrapped between either the headboard 65 or the footboard 66 and the BSR 48/49.

FIG. 2 depicts an end view of the prior art bed assembly 63 of FIG. 1, comprised of mattress 12 (hidden from view), foundation 14 (hidden from view), BSR 48/49, lateral supports 50 (partially shown) and 51 (not shown), headboard 65 (partially obstructed) and footboard 66.

Referring to FIG. 2, inherent gaps 55 and 55*a* are created between mattress 12 and BSR 48/49. In one embodiment, the reason for this gap is the additional space required to raise and lower BSR 48/49 in their normal function. In this illustration, gap 55/55*a* is from about 1–3 inches. Another reason for gap 55/55*a* is the limited adjustment capabilities of supports 50/51.

These "gaps" pose a substantial risk to the patient, becoming entrapped between the mattress 12 and the BSR 48/49.

Degrees and severity of entrapment can vary from patient to patient depending on several factors. These factors include but are not limited to height, weight, cognitive function, and level of ambulatory ability.

Entrapment can involve numerous body parts including but not limited to hands, feet, arms, legs, torso, neck, or head.

Injuries sustained also vary according to the type and length of entrapment. Bruising, sprains and breaks would result from more minor events. More serious injuries up to and including, but not limited to death can also occur in cases of prolonged events involving choking or suffocating entrapments.

These safety concerns have given rise to a multiplicity of lawsuits against hospitals and long-term care facilities. Thus, within the past ten years, the Long Island, N.Y. Developmental Disabilities Service Office has been sued at least twice for injuries and or deaths resulting from a patient's entrapment with a safety rail assembly.

In one care facility, located in Schenectady, N.Y., the management of such facility has discontinued the use of safety rail assemblies in some cases, and now has those patients sleeping on mattresses that have been placed upon the floor. As is apparent, this alternative arrangement presents its own set of problems.

It is therefore an object of this invention to eliminate or greatly reduce the risk of entrapments and injuries sustained therefrom. Preferably, the invention, through proper implementation and monitoring, will eliminate the need for BSR entirely in some cases, or substantially limit the need for their use in others.

It is a further object of this invention to provide a mattress assembly that can be used with or without existing safety rails and which will minimize the likelihood of patient entrapment that exists with the prior art assemblies.

It is a further object of this invention to provide a method and apparatus for retrofitting existing beds so as to eliminate the safety problems set forth above, without having to replace the entire bed unit.

This and other objects of the invention will be described more fully below.

SUMMARY OF THE INVENTION

Disclosed herein is a side panel safety apparatus for a bed, and a related method comprising: a horizontal stabilizer for placement at least partially underneath a mattress of said bed; and a vertically-extending panel attached substantially perpendicularly thereto; wherein: placement of said horizontal stabilizer at least partially underneath said mattress secures said vertically-extending panel in a substantially-vertical orientation along a side of said bed. One embodiment further comprises a cover covering both said mattress and said horizontal stabilizer. Another embodiment comprises the foregoing side panel safety apparatus in combination with a safety rail of said bed, further comprising: said safety rail; wherein: said horizontal stabilizer blocks a person in said bed from moving a part of said person's body into contact with said safety rail such that said body part becomes entrapped from said contact. Another embodiment comprises: said vertically-extending panel comprising at least two movable vertical sections; said horizontal stabilizer comprising at least two horizontal stabilization sections, each said horizontal stabilization section attached substantially perpendicularly to one of said movable vertical sections; and a hinge assembly between two adjacent said movable vertical sections enabling said adjacent movable vertical sections to be rotated relative to one another within a vertical plane of said movable vertical sections.

BRIEF DESCRIPTION OF THE DRAWINGS

The features of the invention believed to be novel are set forth in the appended claims. The invention, however, together with further objects and advantages thereof, may best be understood by reference to the following description taken in conjunction with the accompanying drawing(s) summarized below.

DETAILED DESCRIPTION

Figure 1:
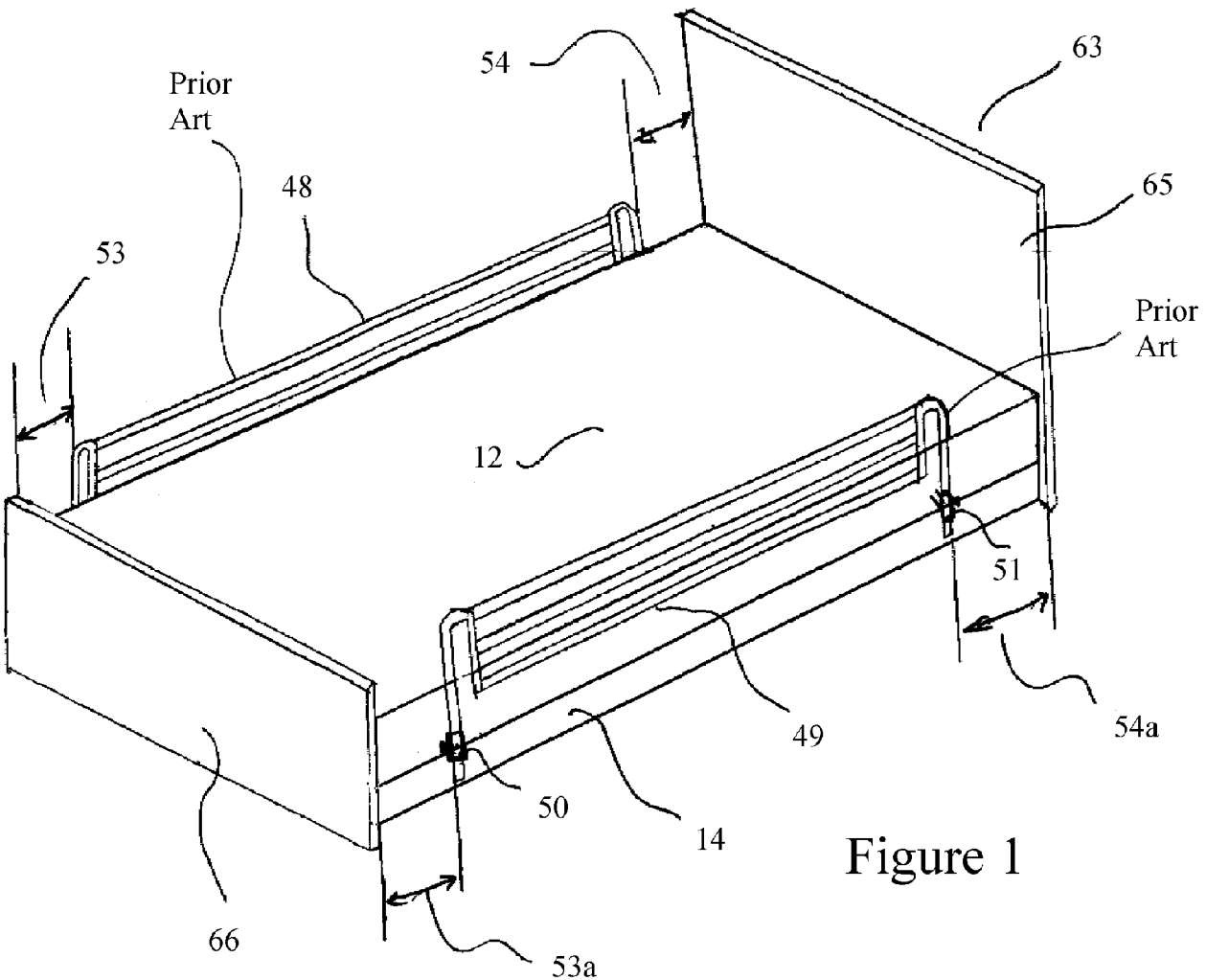
FIG. 1 is a perspective view of a bed assembly utilizing prior art BSR assemblies.
Figure 2:
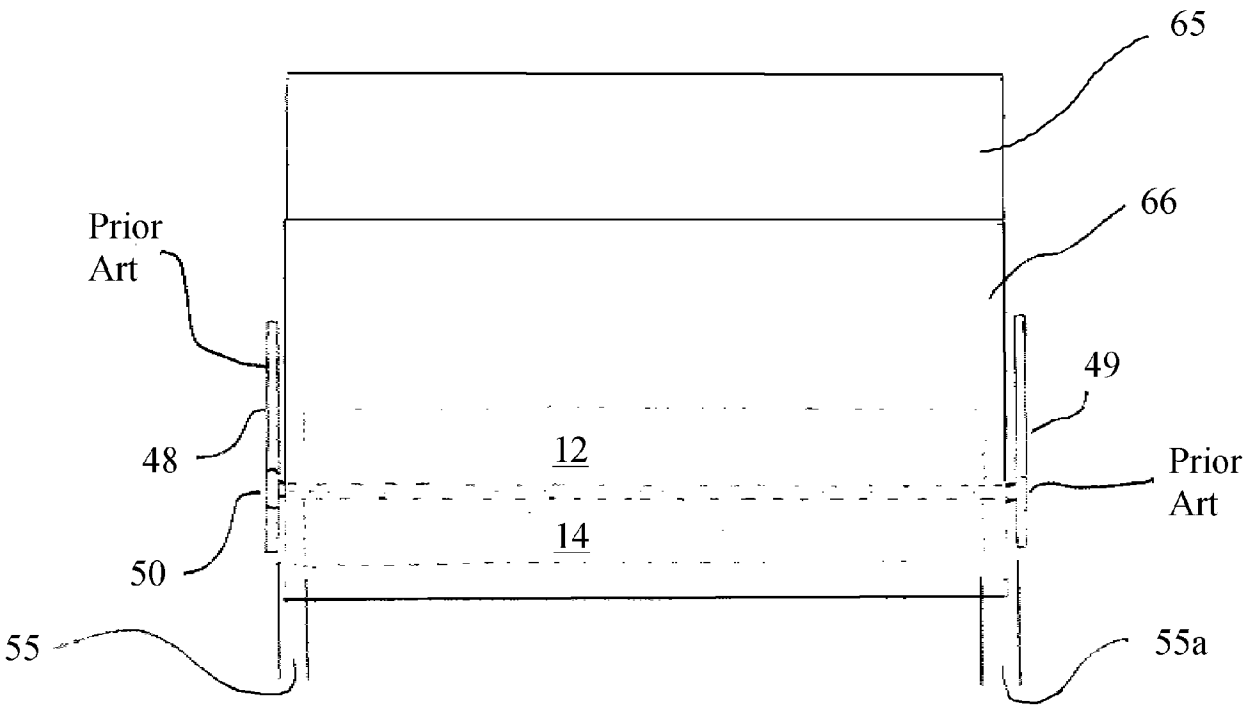
FIG. 2 depicts an end view of a bed assembly utilizing prior art BSR assemblies.
Figure 3:
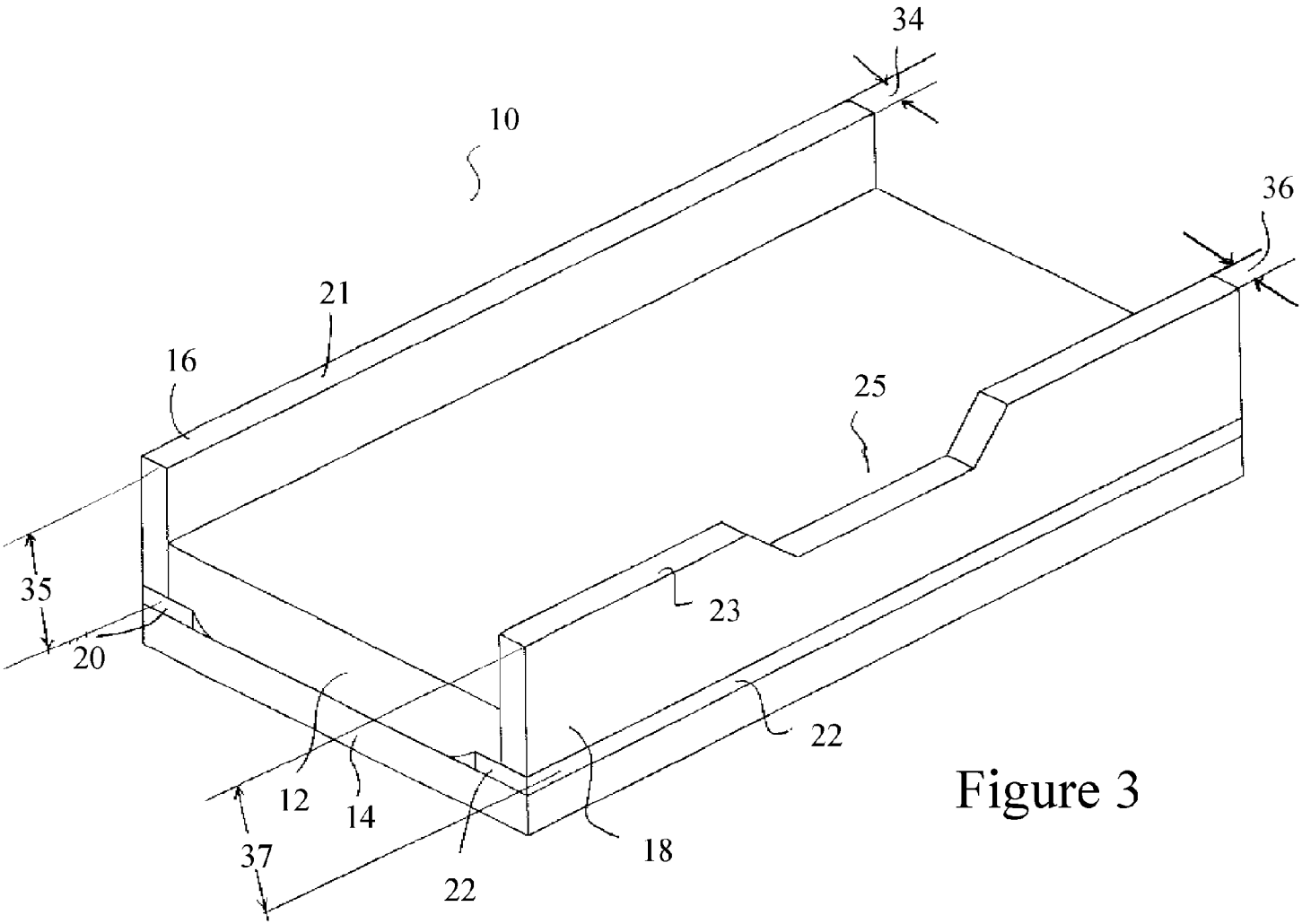
FIG. 3 is a perspective view of a mattress assembly in one embodiment of the invention.

FIG. 3 is a perspective view of a mattress assembly 10 comprised of a mattress 12 disposed on a foundation 14. The foundation 14 may be any base on which a mattress typically sits. It may, e.g., be a box spring, a foundation, a spring platform, a plywood platform, etc.

Referring again to FIG. 3, and disposed on both sides of the mattress 12, are side panels 16 and 18. One of the functions of these side panels 16/18 is to prevent a patient (not shown) disposed on such mattress from having inadvertent contact with structure outside of the side panels 16/18, such as safety rails (see FIGS. 1, 2, 16 and 17).

In the preferred embodiment depicted in FIG. 3, each of side panels 16/18 are preferably L-shaped structures that comprise horizontally extending stabilizers 20 and 22, respectively. The stabilizers 20/22 are preferably disposed, at least in part, underneath mattress 12.

In one embodiment, the mattress 12 is encased within a mattress cover. In another embodiment the mattress 12 is first wrapped with a fireproof material and then enclosed within a mattress cover.

In one embodiment, a fire barrier fabric is used to cover mattress 12, and side panel assemblies 16 and 18; a similar fire barrier fabric may be used to cover the comparable parts of assembly 10' (see FIGS. 10, 11, 12, and 13).

The assemblies 16/18 may be integral assemblies. Alternatively, one may separately make stabilizers 20/22 and join them to vertically-extending panels 21 and 23 using adhesion or a variety of similar attachment techniques known in the art.

Referring again to FIG. 3, it will be seen that vertically extending panel 23 is comprised of a cutout section 25 that, in the embodiment depicted, has a substantially inverted trapezoidal shape. In other embodiments, not shown, different shapes may be used for cutout section 25 including arcuate shapes (oval, circular), square shapes, triangular shapes, irregular shapes, and the like. The purpose of said cutout—irrespective of shape—is to allow the patient ingress and egress to and from the bed. Optionally, should it be required, to give the patient the opportunity to get into or out of bed on either side, said cutout can be made on either or both side panels.

Figure 4:
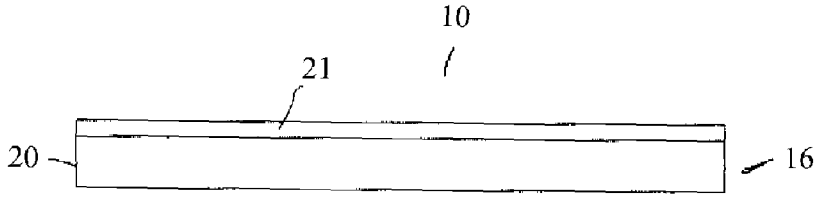
FIG. 4 is a top view of the side panel assembly of FIG. 3.
Figure 6:
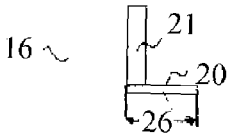
FIG. 6 is an end view of the side panel assembly of FIG. 3.
Figure 5:
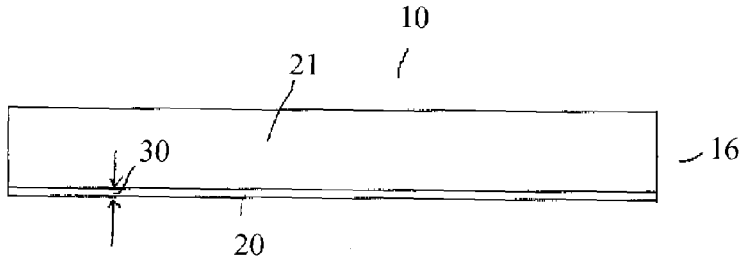
FIG. 5 is a side view of the side panel assembly of FIG. 3.
Figure 7:
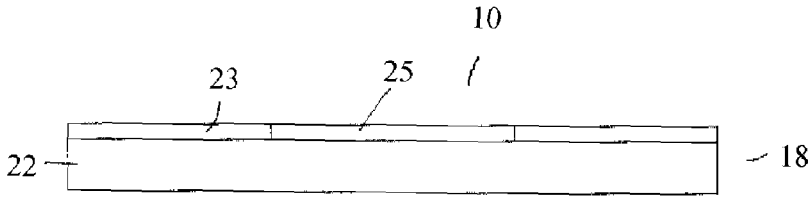
FIG. 7 is a top view of a side panel assembly embodiment with an ingress/egress cutout.
Figure 9:
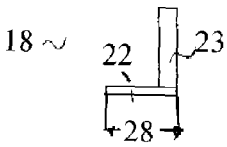
FIG. 9 is an end view of the cutout side panel assembly of FIG. 7.

FIGS. 4, 5, and 6 are top, side, and end views, respectively, of side panel assembly 16. In the preferred embodiment depicted in FIGS. 4, 5, and 6, the stabilizer 20 preferably has a width 26 of from about 4 to about 40 inches; as will be apparent, most of this width 26 will be disposed under mattress 12 (see FIG. 3). Similarly, and referring to FIG. 9, stabilizer 22 preferably has a width 28 of from about 4 to about 40 inches. The widths 26 and 28 may be identical, but need not be identical.

Figure 8:
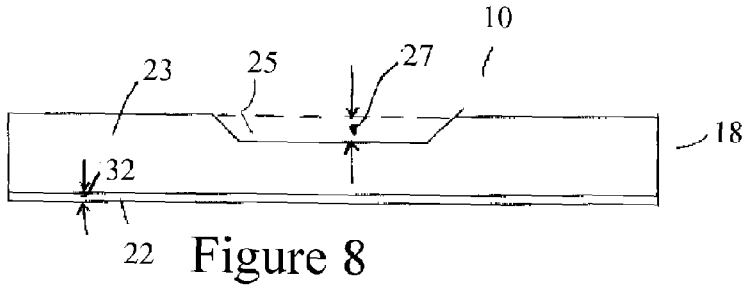
FIG. 8 is a side view of the cutout side panel assembly of FIG. 7.
Figure 10:
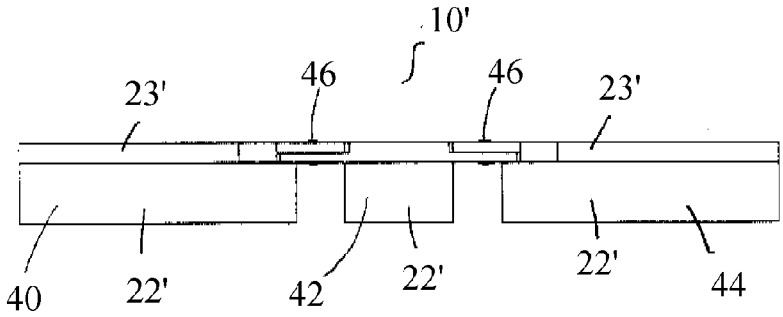
FIG. 10 is a top view of a movable side panel assembly embodiment.
Figure 11:
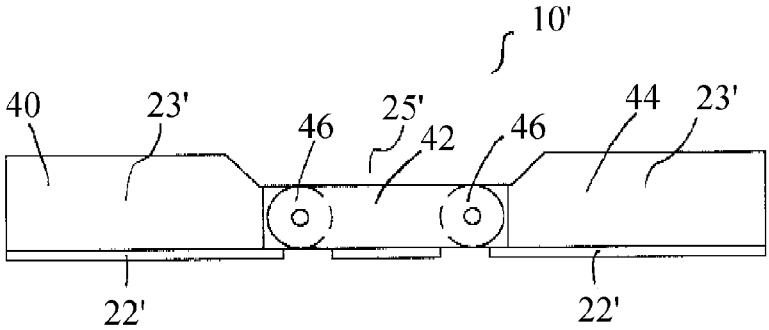
FIG. 11 is a side view of the movable side panel assembly of FIG. 10.
Figure 12:
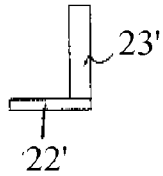
FIG. 12 is an end view of the movable side panel assembly of FIG. 10.
Figure 13:
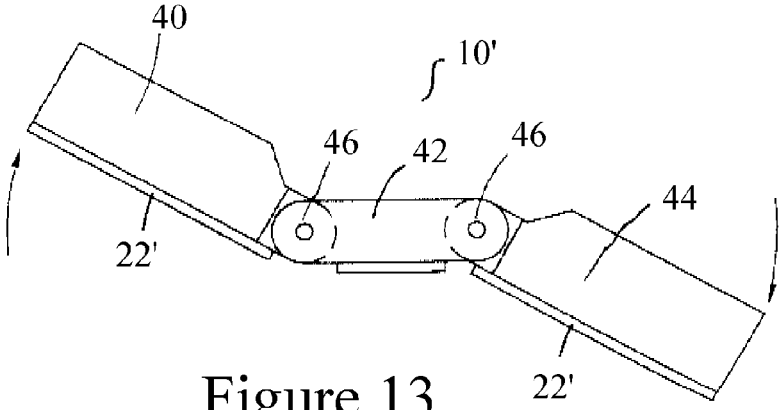
FIG. 13 is a side view of the movable side panel assembly of FIG. 10 illustrating movement of this assembly.

Referring to FIGS. 5 and 8, the stabilizers 20/22 preferably have thicknesses 30 and 32, respectively, of from about 1 to about 2 inches.

In the embodiment depicted in FIG. 3, the stabilizer 22 is shown extending the entire length of panel 23. In one embodiment, stabilizers 20 and 22 are preferably coextensive with upstanding panels 21 and 23, i.e., their lengths are identical. In another embodiment, their regions of overlap run from about 45 to about 86 inches.

Referring to FIG. 3, and in the preferred embodiment depicted therein, each of vertically extending panels 21 and 23 preferably have thicknesses 34/36, respectively from about 1 to 4 inches.

Referring again to FIG. 3, and in the embodiment depicted, it will be seen that vertically extending panels 21/23 preferably have heights 35/37, respectively, of from about 6 to about 24 inches. It is preferred that the heights 35/37 be sufficient such that the panels 21/23 extend above the mattress 12 by from about 1 to about 18 inches.

Referring to FIG. 8, and in the embodiment depicted, it will be seen that the cutout 25 preferably has a maximum depth 27 of from about 2 to about 20 inches, and preferably from about 4 to about 8 inches.

FIGS. 10, 11, 12, and 13 illustrate an embodiment 10' that is similar to the embodiment 10 depicted in FIGS. 3 through 8 but differs therefrom in the following respects: (a) it has only one type of upstanding panel 23 (i.e., panel 23') rather than two different types, (b) it has only one type of stabilizer 22', and the stabilizer 22' is not coextensive with the movable vertical sections 40, 42, and 44 which correspond to head section 40, middle section 42, and foot section 44.

The middle section 42 is rotatably connected to each of head section 40 and foot section 44 by hinge assemblies 46.

Figure 14:
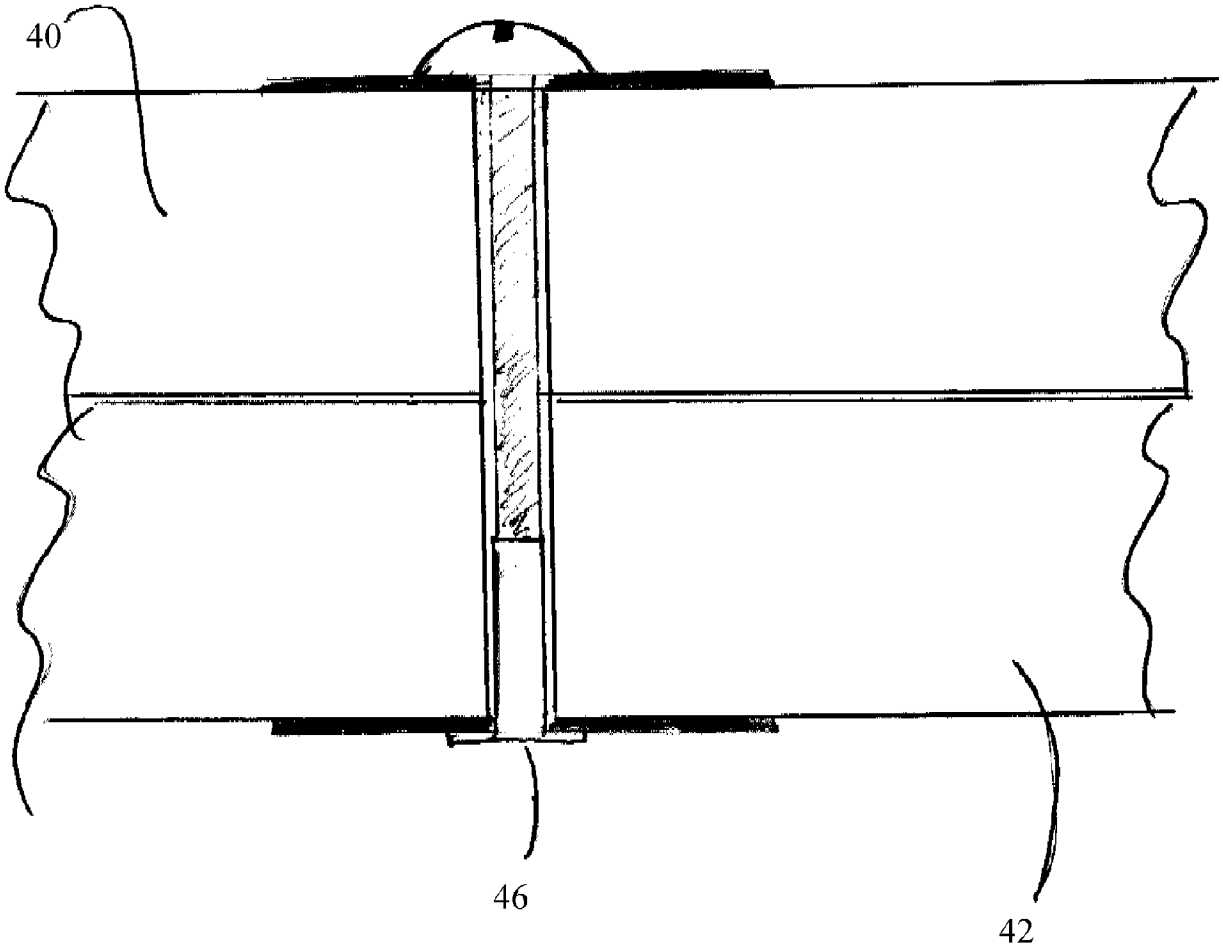
FIG. 14 is a perspective view of the hinge assembly that facilitates said movement illustrated in FIG. 13.

The assembly 10' preferably is disposed upon and contiguous with an adjustable hospital bed (not shown). As the position of the hospital bed changes, the hinge assemblies 46 allow the assembly 10' to change its shape. FIG. 14 is a schematic view, not drawn to scale, of one hinge assembly 46 connecting parts 40 and 42.

The sections 40, 42, and 44 may have identical dimensions, or they may have different dimensions. In the preferred embodiment depicted in FIGS. 10, 11, 12, and 13, each of sections 40 and 44 will preferably have a length of from about 24 to about 42 inches, and it is preferred that such lengths, in one embodiment, be equal. The length of middle section is preferably from about 16 to about 40 inches. But, it is understood that the dimensions of sections 40, 42, and 44 may be varied so as to accommodate differently-dimensioned adjustable hospital beds, and are preferably governed by the particular adjustable bed with which they are intended to be used. The number of sections may also be varied, so that two, three, four, or even more sections may be employed, depending upon the characteristics of the adjustable bed for which they are intended.

Figure 15:
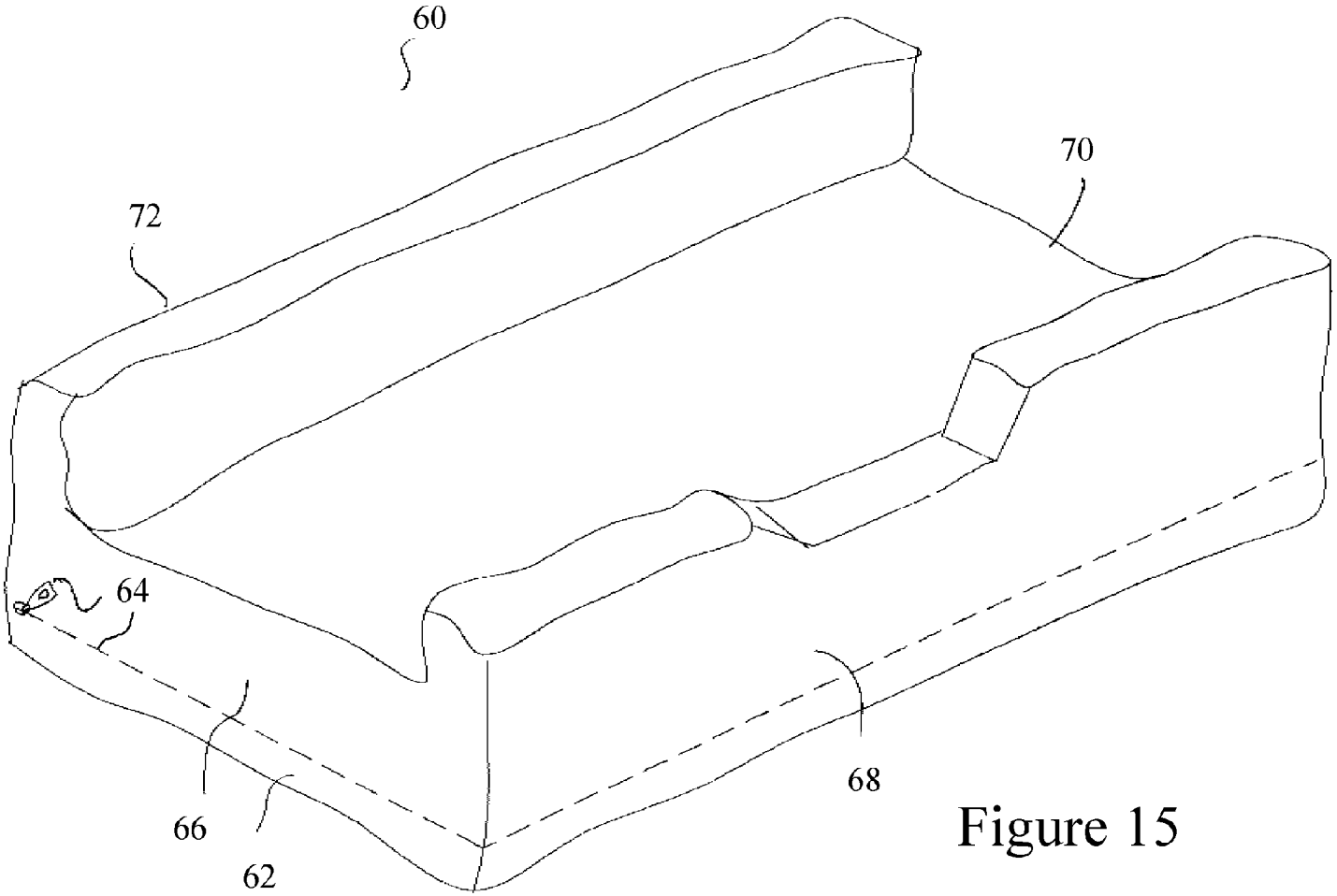
FIG. 15 is a perspective view of a full assembly in various embodiments covered by a cover.

FIG. 15 is a perspective view of a covered mattress assembly 60 comprised of a cover 62. As will be apparent, the assembly being covered (not shown in FIG. 15) is substantially identical to the assembly 10 of FIG. 3, or to the assembly 10' of FIG. 10, whether those assemblies are covered by a fire barrier fabric or not. It is optional although highly preferred that, prior to the time cover 62 is used to encase the entire assembly 10, or 10', the fire barrier "big socks" be disposed around the individual elements of such assemblies (such as, e.g., the mattress 12, and/or the side panel assemblies 16/18).

The cover 62 is preferably comprised, or consists essentially, of fabric made from synthetic polymeric material. The fabric in cover 62 preferably will have flame-retardant, anti-bacterial, and anti-microbial properties. Cover 62 is preferably tailored to fit snugly about the assemblies 10 and 10', though for the 10' (adjustable bed) configuration, the tailoring of cover 62 may require some play for movement of the adjustable bed into various positions other than horizontally flat.

Referring again to FIG. 15, and in the preferred embodiment depicted therein, a zipper 64 is shown extending around side 66 and 68. It is preferred that the zipper also extend around side 70. The zipper may, but need not, also extend around back side 72.

The zipper 64 preferably is constructed from a plastic material, although it may be constructed from metal.

Figure 16:
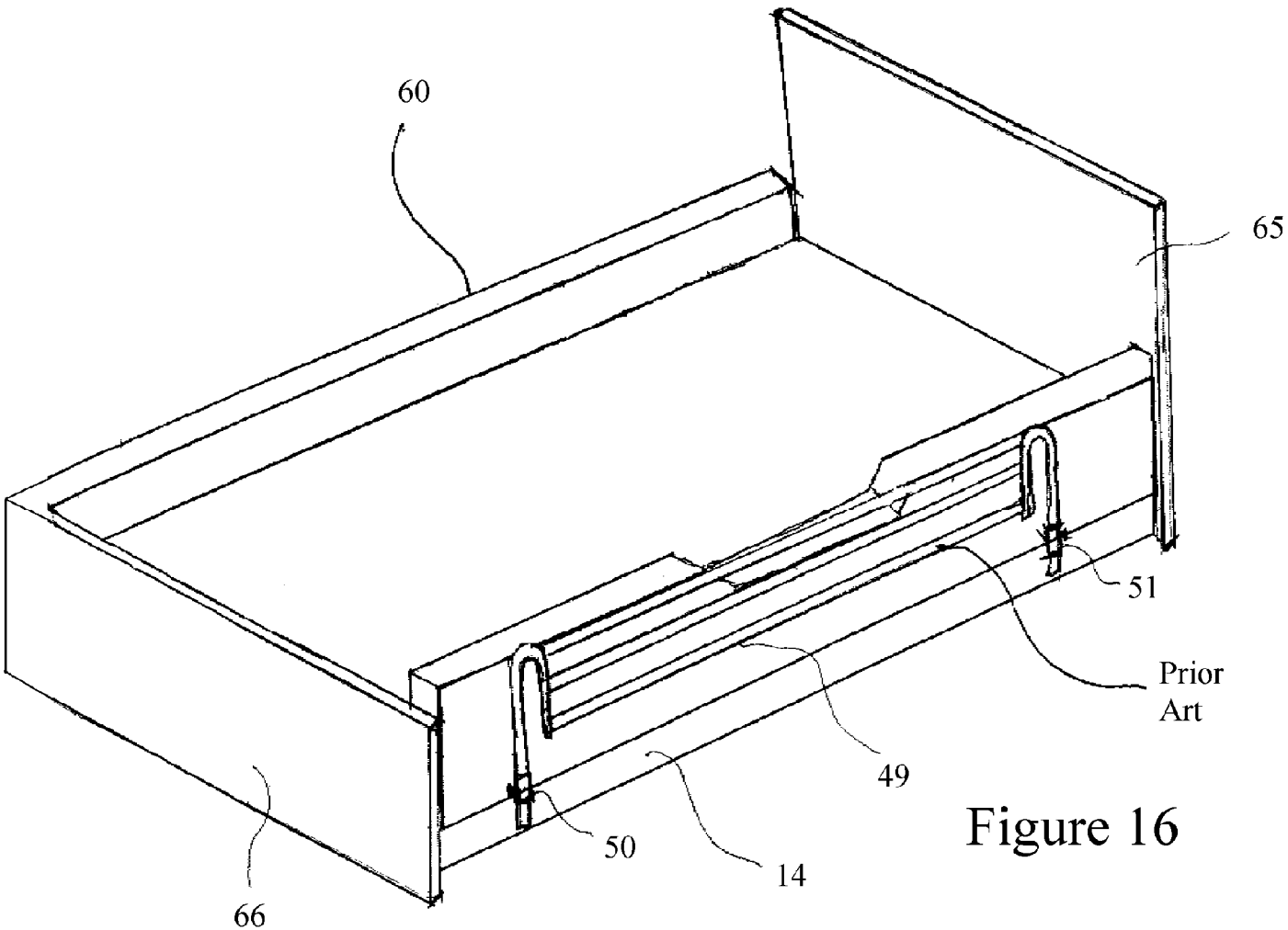
FIG. 16 is a perspective view of a bed assembly which can be in any embodiment of the invention, in combination with a prior art BSR, with the BSR shown in the upper position.
Figure 17:
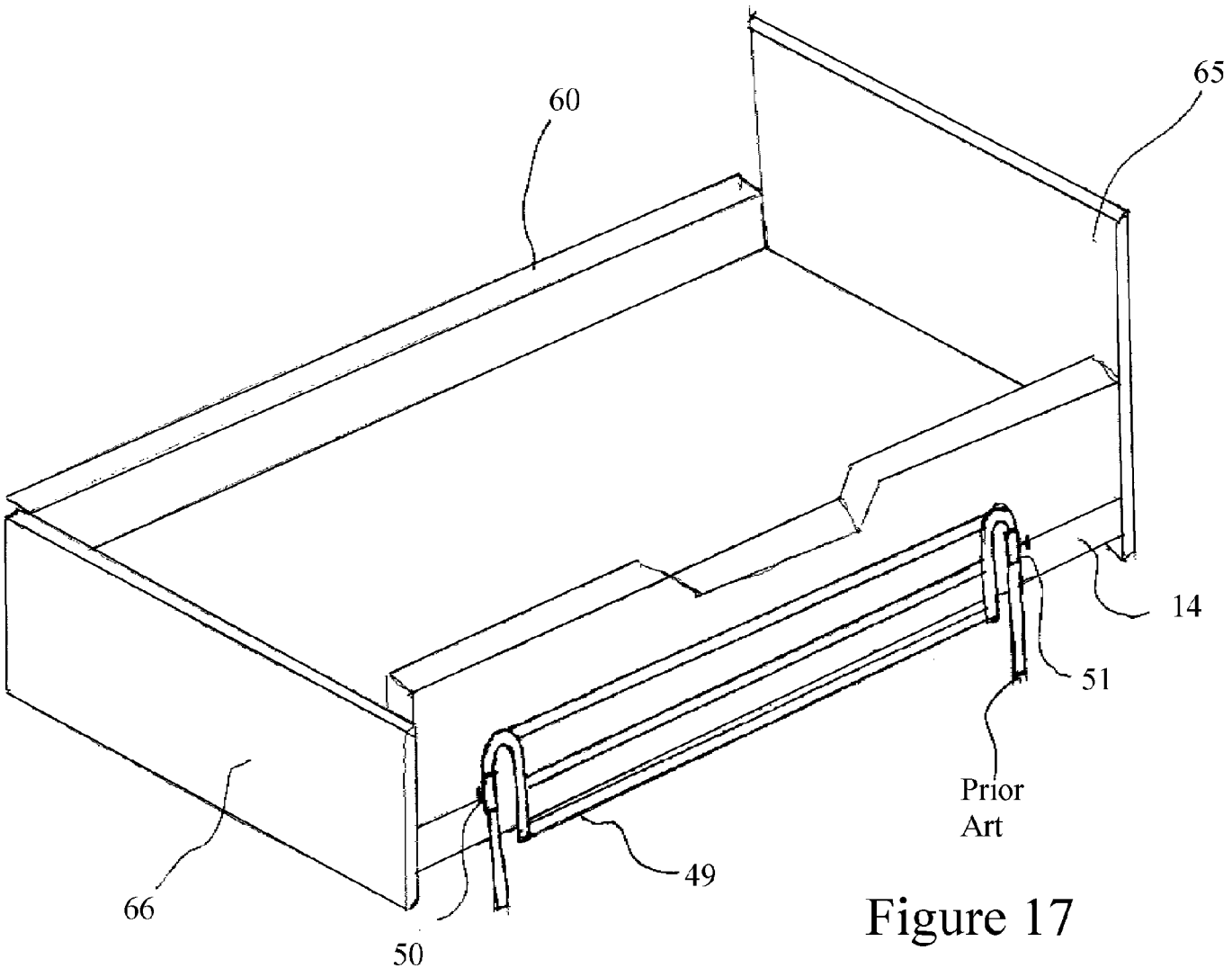
FIG. 17 is a perspective view of a bed assembly according to FIG. 16, with the BSR shown in the lowered position.

FIGS. 16 and 17 illustrate a preexisting bed with a Bed Safety Rail (BSR), which has been retrofitted with an invention embodiment to eliminate the safety hazards earlier discussed. That is, these figures illustrate an embodiment of the invention in combination with a preexisting bed and prior art BSR system.

Referring to FIG. 16, depicting covered mattress assembly 60 in place, in combination with the BSR 48 (obscured from view), and 49 in the upper position, individuals, primarily those of diminished mental or physical capacity, are "trained" to learn the lateral limits of their respective bed assembly, by coming in contact with the elevated side panel 16 or 18 prior to BSR 48/49. This training process will preferably take from about 1 to 4 weeks, although in some cases, a longer time may be required.

Following this training period utilizing this combination of bed assembly 60 and the BSR 48/49 assemblies, the BSR 48/49 will remain in place on the bed assembly in the lowered or down position as depicted in FIG. 17. This adjustment period will preferably take from about 1 to 4 weeks, although in some cases, a longer time may be required.

During this adjustment period, frequent (e.g., every 15 minutes) bed checks will be made to ensure that no notable events, or safety issues arise. As the adjustment period progresses, the frequency of said bed checks may be extended as is clinically appropriate.

In the embodiments shown, it is highly preferred, but optional, to cover all of the surfaces of each of these structures with the fire barrier fabric.

Instead of using fire barrier fabric, one may use any other fire barrier materials, such as foams, coatings, etc.

One may use any of the fire barrier fabrics that are commercially available. In one embodiment, the fire barrier fabric is "INTEGRITY 30," sold by the Ventex Company of P.O. Box 1038, Great Falls, Va. This material is a knitted fire barrier that comprises modacrylic fiber, fiberglass, and polyester fiber. In one embodiment, it is affixed to the assemblies depicted by either metal staples, or glass thread, or Kevlar thread, or any other suitable equivalent attachment means. In another embodiment, it is used to make a cover that is disposed over each respective assembly but is not necessarily affixed thereto. In this latter embodiment, the fire barrier fabric made from the fire barrier fiber may be referred to as a "big sock."

The side panels 16 and 18 preferably are assemblies that, in one embodiment, are made from a synthetic polymeric material. In one embodiment, the density of the polymeric material is from about 1 to about 10 pounds per cubic foot.

In one embodiment, it is preferred that the synthetic polymeric material have density of less than about 3 pounds per cubic foot and, more preferably, less than about 2.5 pounds per cubic foot. In one embodiment, the density of the polymeric material is less than about 2.3 pounds per cubic foot.

In one embodiment, the polymeric material has an indentation load deflection (ILD) of from about 50 to about 500 pounds and, more preferably, from about 100 to about 250 pounds. In one aspect of this embodiment, the material has an ILD of from about 75 to about 200 pounds.

It is preferred that the polymeric material be substantially inflammable. As used in this specification, the term substantially inflammable refers to a material that passes a test such as described in California Technical Bulletin 117, or a similar set of standards.

In one embodiment, the polymeric material is a polyethylene that preferably is a high-density polyethylene with crystallinity in excess of about 80 percent.

In another embodiment, the polymeric material is polyethylene foam. In one aspect of this embodiment, the polyethylene foam is "ETHAFOAM 4101" sold by the Dow Chemical Company of Midland, Mich. The material has a compression set, as measured by ASTM D3575 (Suffix B) of less than about 20 percent.

In another embodiment, the polymeric material is polyurethane with an ILD of from about 50 to about 500 pounds. Other similar polymeric materials possessing equal or greater qualities also may be used.

One material that may be used to make cover 62 is "DAF AntiBac" manufactured by DAF Products, Inc., 420 Braen Avenue, Wyckoff, N.J. The material has a weight of from about 9 to about 15 ounces per square yard and is made from a 3-ply polyvinyl chloride reinforced laminate. This material is flame resistant (passing California Technical Bulletin test 117 and NFPA 701 Small Scale), it is mildew resistant, and it is antibacterial. Other similar fabrics possessing equal or greater qualities also may be used.

This invention accomplishes its objects through providing solid "gap free" side panels 16 and 18 disposed on mattress 12 and encased in cover 62 with or without the fire barrier "big socks". This eliminates the gaps 53/53*a*, 54/54*a*, and 55/55*a* as previously described, as well as any interbar spacing inherent in the BSR 48/49 as depicted, or otherwise not shown.

Another unique feature of the product is that no sleep surface is lost when the disclosed assembly is used, because it is applied to the outside edges of the mattress and does not at all overlap the top surface of the mattress.

Preferably, this invention will initially be used as a training device, installed on any given patient's bed assembly that indicates the use of BSR 48/49 assemblies.

With the invention in place, and the BSR 48/49 in the upper position, individuals, primarily those of diminished mental or physical capacity, are "trained" to learn the lateral limits of their respective bed assembly, by coming in contact with the elevated side panel 16 or 18 prior to BSR 48/49. This training process will preferably take from about 1 to 4 weeks, although in some cases, a longer time may be required.

Following this training period utilizing both this invention and the BSR 48/49 assemblies, the BSR 48/49 will remain in place on the bed assembly in the lowered or down position. This adjustment period will preferably take from about 1 to 4 weeks, although in some cases, a longer period may be required.

During this adjustment period, frequent (every 15 minutes) bed checks will be made to ensure that no notable events, or safety issues arise. As the adjustment period progresses, the frequency of said bed checks may be extended as is clinically appropriate.

Preferably, upon completion of these training and adjustment periods, all parties involved with the care of each individual including but not limited to staff, nurses, doctors, occupational and physical therapists, family members, and even in some case patients will be comfortable with completely removing the BSR 48/49 assemblies, thus removing any risk of entrapment with BSR assemblies.

While only certain preferred features of the invention have been illustrated and described, many modifications, changes and substitutions will occur to those skilled in the art. It is, therefore, to be understood that the appended claims are intended to cover all such modifications and changes as fall within the true spirit of the invention.

What is claimed is:

1. A side panel safety apparatus for placement on one side only of a bed, comprising:

a horizontal stabilizer for placement underneath only part of a mattress of said bed;

a vertically-extending panel attached substantially perpendicularly thereto; and a cover, separate and distinct from said mattress and said side panel safety apparatus, for covering both said mattress and said side panel safety apparatus; wherein:

said horizontal stabilizer is dimensioned to run partially but not fully underneath said mattress;

said side panel safety apparatus is a module separate and distinct from any opposite-side panel safety apparatus for placement on an opposite side of said bed therefrom; and placement of said horizontal stabilizer underneath only said part of said one side only of said mattress secures said vertically-extending panel in a substantially-vertical orientation along said one side only of said bed.

2. The apparatus of claim 1, in combination with an opposite-side panel safety apparatus for placement on said opposite side of said bed, comprising:

an opposite-side horizontal stabilizer for placement underneath only part of said mattress; and an opposite-side vertically-extending panel attached substantially perpendicularly thereto;

a substantially L-shaped opposite-side joint between said horizontal stabilizer and said vertically-extending panel wherein:

said opposite-side horizontal stabilizer is dimensioned to run partially but not fully underneath said mattress;

said opposite-side panel safety apparatus is a module separate and distinct from said side panel safety apparatus; and placement of said opposite-side horizontal stabilizer underneath only part of said opposite side of said mattress secures said vertically-extending panel in a substantially-vertical orientation along said opposite side of said bed.

3. The apparatus of claim 2, further comprising:

a cover, separate and distinct from said mattress, said side panel safety apparatus, and said opposite-side panel safety apparatus, for covering all of said mattress, said side panel safety apparatus, and said opposite-side panel safety apparatus.

4. A method for ensuring bed safety, comprising:

securing a vertically-extending panel in a substantially-vertical orientation along one side only of a bed by placing a horizontal stabilizer of a side panel safety apparatus underneath only part of said one side only of a mattress of said bed; and covering both said mattress and said side panel safety apparatus with a cover separate and distinct from said mattress and said side panel safety apparatus; wherein:

said vertically-extending panel is attached substantially perpendicularly to said horizontal stabilizer;

said horizontal stabilizer is dimensioned to run partially but not fully underneath said mattress; and said side panel safety apparatus is a module separate and distinct from any opposite-side panel safety apparatus for placement on an opposite side of said bed therefrom.

5. The method of claim 4, further comprising:

securing an opposite-side vertically-extending panel in a substantially-vertical orientation along said opposite side of said bed by placing an opposite-side horizontal stabilizer of an opposite-side panel safety apparatus underneath only part of said opposite-side of said mattress; wherein:

said opposite-side vertically-extending panel is attached substantially perpendicularly to said opposite-side horizontal stabilizer;

said opposite-side horizontal stabilizer is dimensioned to run partially but not fully underneath said mattress; and said opposite-side panel safety apparatus is a module separate and distinct from said side panel safety apparatus.

6. The method of claim 5, further comprising:

covering all of said mattress, said side panel safety apparatus, and said opposite-side panel safety apparatus with a cover separate and distinct from said mattress, said side panel safety apparatus, and said opposite-side panel safety apparatus.

7. A side panel safety apparatus for placement on one side only of a bed, in combination with a safety rail on said one side only of said bed, comprising:

a horizontal stabilizer for placement underneath only part of a mattress of said bed;

a vertically-extending panel attached substantially perpendicularly thereto; and said safety rail; wherein:

said horizontal stabilizer is dimensioned to run partially but not fully underneath said mattress;

said side panel safety apparatus is a module separate and distinct from any opposite-side panel safety apparatus for placement on an opposite side of said bed therefrom;

placement of said horizontal stabilizer underneath only said part of said one side only of said mattress secures said vertically-extending panel in a substantially-vertical orientation along said one side only of said bed; and said vertically-extending panel blocks a person in said bed from moving a part of said person's body into contact with said safety rail such that said body part becomes entrapped from said contact.

8. The apparatus of claim 7, in combination with an opposite-side panel safety apparatus for placement on said opposite side of said bed, comprising:

an opposite-side horizontal stabilizer for placement underneath only part of said mattress; and an opposite-side vertically-extending panel attached substantially perpendicularly thereto;

a substantially L-shaped opposite-side joint between said horizontal stabilizer and said vertically-extending panel wherein:

said opposite-side horizontal stabilizer is dimensioned to run partially but not fully underneath said mattress;

said opposite-side panel safety apparatus is a module separate and distinct from said side panel safety apparatus; and placement of said opposite-side horizontal stabilizer underneath only part of said opposite side of said mattress secures said vertically-extending panel in a substantially-vertical orientation along said opposite side of said bed.

9. The apparatus of claim 8 in combination with an opposite-side safety rail on said opposite said of said bed, further comprising:

said opposite-side safety rail; wherein:

said opposite-side vertically-extending panel blocks a person in said bed from moving a part of said person's body into contact with said opposite-side safety rail such that said body part becomes entrapped from said contact.

10. A method for ensuring bed safety, comprising:

securing a vertically-extending panel in a substantially-vertical orientation along one side only of a bed by placing a horizontal stabilizer of a side panel safety apparatus underneath only part of said one side only of a mattress of said bed; wherein:

said vertically-extending panel is attached substantially perpendicularly to said horizontal stabilizer;

said horizontal stabilizer is dimensioned to run partially but not fully underneath said mattress;

said side panel safety apparatus is a module separate and distinct from any opposite-side panel safety apparatus for placement on an opposite side of said bed therefrom; and said vertically-extending panel blocking a person in said bed from moving a part of said person's body into contact with a safety rail on said one side only of said bed such that said body part becomes entrapped from said contact.

11. The method of claim 10, further comprising:

securing an opposite-side vertically-extending panel in a substantially-vertical orientation along said opposite side of said bed by placing an opposite-side horizontal stabilizer of an opposite-side panel safety apparatus underneath only part of said opposite-side of said mattress; wherein:

said opposite-side vertically-extending panel is attached substantially perpendicularly to said opposite-side horizontal stabilizer;

said opposite-side horizontal stabilizer is dimensioned to run partially but not fully underneath said mattress; and said opposite-side panel safety apparatus is a module separate and distinct from said side panel safety apparatus.

12. The method of claim 11, further comprising:

said opposite-side vertically-extending panel blocking a person in said bed from moving a part of said person's body into contact with an opposite-side safety rail on said on said opposite said of said bed such that said body part becomes entrapped from said contact.

13. A side panel safety apparatus for placement on one side only of a bed, comprising:

a horizontal stabilizer for placement underneath only part of a mattress of said bed, said horizontal stabilizer comprising at least two horizontal stabilization sections, each said horizontal stabilization section attached substantially perpendicularly to one of at least two movable vertical sections;

a vertically-extending panel attached substantially perpendicularly thereto, said vertically-extending panel comprising at least two of said movable vertical sections; and a hinge assembly enabling said adjacent movable vertical sections to be rotated relative to one another within a vertical plane of said movable vertical sections; wherein:

said horizontal stabilizer is dimensioned to run partially but not fully underneath said mattress;

said side panel safety apparatus is a module separate and distinct from any opposite-side panel safety apparatus for placement on an opposite side of said bed therefrom; and placement of said horizontal stabilizer underneath only said part of said one side only of said mattress secures said vertically-extending panel in a substantially-vertical orientation along said one side only of said bed.

14. The apparatus of claim 13, in combination with an opposite-side panel safety apparatus for placement on said opposite side of said bed, comprising:

an opposite-side horizontal stabilizer for placement underneath only part of said mattress; and an opposite-side vertically-extending panel attached substantially perpendicularly thereto;

a substantially L-shaped opposite-side joint between said horizontal stabilizer and said vertically-extending panel wherein:

said opposite-side horizontal stabilizer is dimensioned to run partially but not fully underneath said mattress;

said opposite-side panel safety apparatus is a module separate and distinct from said side panel safety apparatus; and placement of said opposite-side horizontal stabilizer underneath only part of said opposite side of said mattress secures said vertically-extending panel in a substantially-vertical orientation along said opposite side of said bed.

15. The apparatus of claim 14:

said opposite-side vertically-extending panel comprising at least two movable opposite-side vertical sections;

said opposite-side horizontal stabilizer comprising at least two opposite-side horizontal stabilization sections, each said opposite-side horizontal stabilization section attached substantially perpendicularly to one of said movable opposite-side vertical sections; further comprising:

an opposite-side hinge assembly enabling said adjacent movable opposite-side vertical sections to be rotated relative to one another within a vertical plane of said movable opposite-side vertical sections.

16. A method for ensuring bed safety, comprising:

securing a vertically-extending panel in a substantially-vertical orientation along one side only of a bed by placing a horizontal stabilizer of a side panel safety apparatus underneath only part of said one side only of a mattress of said bed; and rotating adjacent movable vertical sections of said vertically-extending panel relative to one another within a vertical plane of said movable vertical sections by rotating a hinge assembly; wherein:

said vertically-extending panel is attached substantially perpendicularly to said horizontal stabilizer;

said horizontal stabilizer is dimensioned to run partially but not fully underneath said mattress;

said side panel safety apparatus is a module separate and distinct from any opposite-side panel safety apparatus for placement on an opposite side of said bed therefrom; and said horizontal stabilizer comprises at least two horizontal stabilization sections, each said horizontal stabilization section attached substantially perpendicularly to one of said movable vertical sections.

17. The method of claim 16, further comprising:

securing an opposite-side vertically-extending panel in a substantially-vertical orientation along said opposite side of said bed by placing an opposite-side horizontal stabilizer of an opposite-side panel safety apparatus underneath only part of said opposite-side of said mattress; wherein:

said opposite-side vertically-extending panel is attached substantially perpendicularly to said opposite-side horizontal stabilizer;

said opposite-side horizontal stabilizer is dimensioned to run partially but not fully underneath said mattress; and said opposite-side panel safety apparatus is a module separate and distinct from said side panel safety apparatus.

18. The method of claim 17, further comprising:

rotating adjacent movable opposite-side vertical sections of said opposite-side vertically-extending panel relative to one another within a vertical plane of said movable opposite-side vertical sections by rotating an opposite-side hinge assembly; wherein:

said opposite-side horizontal stabilizer comprises at least two opposite-side horizontal stabilization sections, each said opposite-side horizontal stabilization section attached substantially perpendicularly to one of said movable opposite-side vertical sections.

* * * * *